US012038245B2

(12) United States Patent
Faizan et al.

(10) Patent No.: US 12,038,245 B2
(45) Date of Patent: Jul. 16, 2024

(54) METHOD AND SYSTEM FOR PREVENTING INJURY BY FRIENDLY FIRE

(71) Applicant: Mirza Faizan, Irving, TX (US)

(72) Inventors: Mirza Faizan, Irving, TX (US); Aarish Salman Bhojani, Euless, TX (US); Nadia Anisa Sethuraman, Dallas, TX (US); Sofia Sethuraman, Dallas, TX (US); Raahi S Jogani, Sunnyvale, TX (US); Zaid Marwat, Allen, TX (US); Mirza Rizwan, Patna (IN); Abdullah Hasani, Murphy, TX (US); Hisham Ahmad, Allen, TX (US)

( * ) Notice: Subject to any disclaimer, the term of this patent is extended or adjusted under 35 U.S.C. 154(b) by 155 days.

(21) Appl. No.: 17/942,735

(22) Filed: Sep. 12, 2022

(65) Prior Publication Data

US 2024/0085134 A1 Mar. 14, 2024

(51) Int. Cl.
*F41A 17/08* (2006.01)
*F41A 17/06* (2006.01)

(52) U.S. Cl.
CPC ..... *F41A 17/08* (2013.01); *F41A 17/06* (2013.01)

(58) Field of Classification Search
CPC ..... F41A 17/08; F41A 17/06
USPC ..... 89/132
See application file for complete search history.

(56) References Cited

U.S. PATENT DOCUMENTS

2006/0082730 A1* 4/2006 Franks ..... G08B 13/19647 348/E7.088
2015/0241153 A1* 8/2015 Mardirossian ..... F41A 17/063 42/70.11
2018/0190095 A1* 7/2018 Leegate ..... G08B 23/00
2019/0249958 A1* 8/2019 Teetzel ..... F41G 3/12
2020/0109905 A1* 4/2020 Black ..... G08B 13/2448
2022/0390200 A1* 12/2022 Faizan ..... F41A 17/063

FOREIGN PATENT DOCUMENTS

RU 2728511 C1 * 7/2020

* cited by examiner

*Primary Examiner* — Samir Abdosh

(57) ABSTRACT

A method for providing a smart monitoring device to determine at least one user as a team mate is provided. The method includes attaching, by a processor, a thermal signature emitting unit at one inner portion of the user's clothes, wherein the thermal signature emitting unit corresponds to a temperature signature of a metal insignia. Next, the method includes connecting, by the processor, an AI-based thermal camera module to a gun to detect data related to the thermal signature of the metal insignia. Further, the method includes comparing, by the processor, the data received from the AI-based thermal camera module with the patterns of the metal insignia stored in the database. Lastly, the method includes displaying, by a display unit, a red-cross symbol to the user if the data is matched, wherein the red-cross symbol symbolizes not to shoot.

10 Claims, 5 Drawing Sheets

METHOD AND SYSTEM FOR PREVENTING INJURY BY FRIENDLY FIRE

TECHNICAL FIELD

The present invention generally relates to the field of electronic devices and electronic monitoring devices and more particularly to systems and methods for providing a smart monitoring device to a user such as an insignia with a smart system.

BACKGROUND OF THE INVENTION

As is generally known in today's world, the use of weapons is required based on the increase in crime rate and the evolution and ability of criminals with the ease of access to weapons. The use of weapons is also well known for the purpose of defense and protection of a country by its defense forces. In the rush of adrenaline and sometimes due to nervousness, policemen or army units sometimes shoot one of their own due to darkness or the inability to identify their fellow persons as the rate of combat is rapid and the reaction time is very small. There is a need to design a system to prevent such an incident.

Based on the prior arts and the present existing technology there is a need for a smart monitoring system that enables the user to identify his team members and avoid such an accidental situation during combat action.

In conclusion, there is a need for a smart monitoring system that is capable of preventing accidental encounters among members of the same team or fighting on the same side and enables the users to identify their own even in highly threatening and complicated situations such as a hostage situation or a dark combat situation, etc.

Further limitations and disadvantages of conventional and traditional approaches will become apparent to one of skill in the art, through comparison of described systems with some aspects of the present disclosure, as set forth in the remainder of the present application and with reference to the drawings.

SUMMARY OF THE INVENTION

The foregoing summary is illustrative only and is not intended to be in any way limiting. In addition to the illustrative aspects, embodiments, and features described above, further aspects, embodiments, and features will become apparent by reference to the drawings and the following detailed description.

According to embodiments illustrated herein, the present invention discloses a method and system for providing a smart system with the ability to able the user to identify the person and avoid accidental encounters which may lead to nervous or accidental killings of fellow team members. In an example, the system consists of two components such as a thermal signature emitting unit and a small AI-based thermal camera module connected to the gun.

The use of an insignia which is a distinguishing badge or emblem of military rank, office, or membership of an organization is commonly known among defense and police personnel. This insignia can be used to enable the personnel to identify their team members or one of their own and avoid such accidental encounters. With the use of a smart thermal signature emitting unit and a smart system which enables the person in action to identify their fellow team members, such incidences can be avoided. If the user is capable of determining the safety/threat level of an individual, providing a host of capabilities, systems, procedures, and technology to improve that safety level or address specific threats using the present system, then such a situation can be avoided.

According to embodiments illustrated herein, there may be provided a method for providing a smart monitoring device to determine at least one user as a team mate. The method includes attaching, by a processor, a thermal signature emitting unit at one inner portion of the user's clothes, wherein the thermal signature emitting unit corresponds to a temperature signature of a metal insignia. Next, the method includes connecting, by the processor, an AI-based thermal camera module to a gun to detect data related to the thermal signature of the metal insignia. Further, the method includes comparing, by the processor, the data received from the AI-based thermal camera module with the patterns of the metal insignia stored in the database. Lastly, the method includes displaying, by a display unit, a red-cross symbol to the user when the data is matched by the comparison, wherein the red-cross symbol indicates the user not to shoot.

According to embodiments illustrated herein, there may be provided a system for providing a smart monitoring device to determine at least one user as a team mate. The system includes a processor to attach a thermal signature emitting unit at one inner portion of the user's clothes, wherein the thermal signature emitting unit corresponds to a temperature signature of a metal insignia. The system further includes the processor to connect an AI-based thermal camera module to a gun to detect data related to the thermal signature of the metal insignia. Next, the system includes the processor to compare the data received from the AI-based thermal camera module with the patterns of the metal insignia stored in the database. Lastly, the system includes a display unit to display a red-cross symbol to the user when the data is matched by the comparison, wherein the red-cross symbol indicates the user not to shoot.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

Figure 1A:
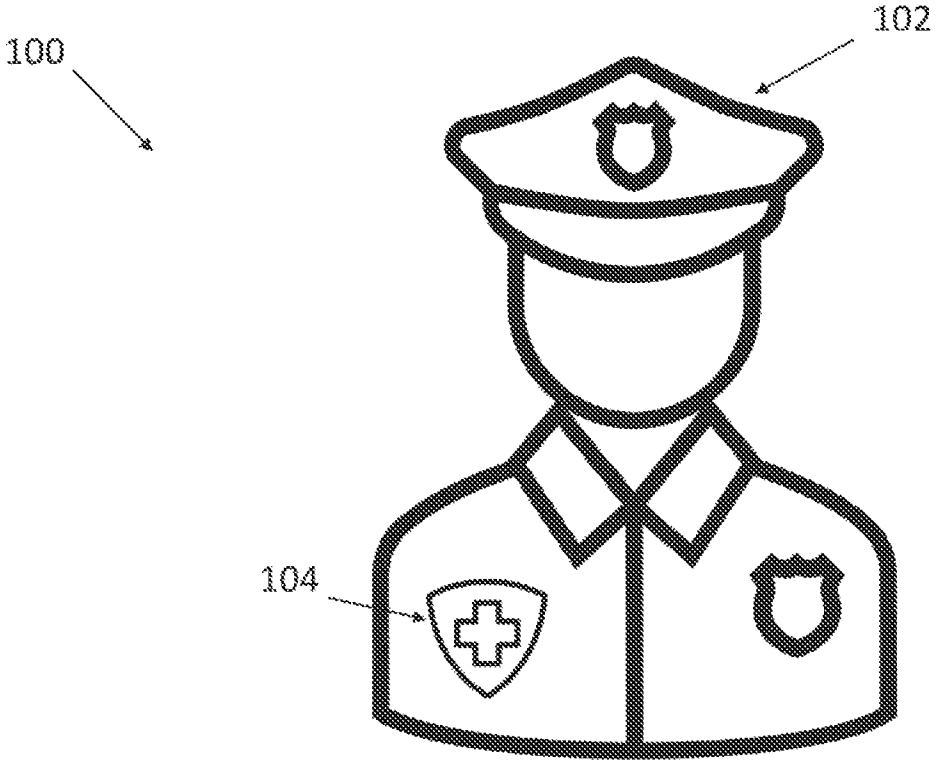
FIG. 1A is an exemplary network environment diagram 100 that illustrates a smart monitoring device, in accordance with some embodiments of the present disclosure.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in a computer-readable medium and executed by a computer or processor, whether or not such computer or processor is explicitly shown.

DETAILED DESCRIPTION

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specify the presence of what follows e.g. component and do not exclude or preclude the presence of additional, non-recited components, features, element, members, steps, known in the art or disclosed therein.

Furthermore, the terms first, second, third, and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

The recitation of numerical ranges by endpoints includes all numbers and fractions subsumed within that range, as well as the recited endpoints. The expression "% by weight", "weight percent", "% wt" or "wt %", here and throughout the description unless otherwise defined, refers to the relative weight of the respective component based on the overall weight of the formulation.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

Unless otherwise defined, all terms used in disclosing the invention, including technical and scientific terms, have the meaning as commonly understood by one of ordinary skill in the art to which this invention belongs. By means of further guidance, definitions for the terms used in the description are included to better appreciate the teaching of the present invention. The terms or definitions used herein are provided solely to aid in the understanding of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures, or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention and form different embodiments, as would be understood by those in the art. For example, in the following claims, any of the claimed embodiments may be used in any combination.

It is desirable to have a new system and method that solves the above challenges as well as helps the users with a cost-effective, reliable, and efficient way of managing the day-to-day work. The present device is capable of providing the user with a small secret insignia made up of any metal to be inserted inside the bullet proof vest or other places of policemen or defense personnel. This secret insignia could be changed so that bad guys don't copy it to save themselves from getting shot. With the evolution of technology and the right use of digital devices the insignia can be coupled with a smart system to enable the user to differentiate between their own and the opponents or criminals in a combat situation.

The present system is developed consisting of a small AI-based thermal camera module connected to the gun. This module will detect the thermal signature of this insignia (metals normally have a lower temperature than the human body). Once the low-temperature signature of metal insignia is detected, the AI system compares it with the pattern of insignia in its database. If it matches, it displays a small RED CROSS which means don't shoot.

FIG. 1A is an exemplary environment diagram 100 that illustrates a user (policeman or army man) 102, in accordance with some embodiments of the present disclosure. As shown in FIG. 1, a thermal signature emitting unit 104 is inserted into an inner portion of the user's clothes. For example, the thermal signature emitting unit 104 corresponds to a temperature signature of a metal insignia. The thermal signature of the metal insignia is inserted inside the bullet proof vest or any other place according to the desire of the user 102. A person skilled in the art would understand that any other devices, not mentioned explicitly, may also be used as the thermal signature emitting unit 104 in the present disclosure.

Figure 1B:
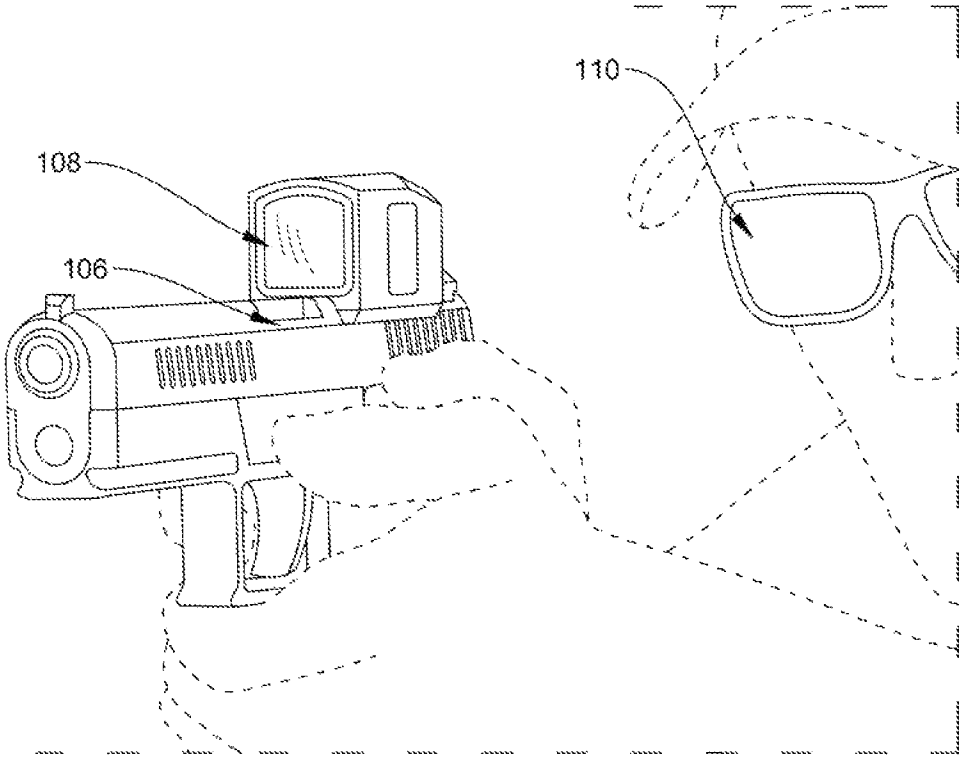
FIG. 1B is an exemplary scenario that illustrates a gun holding user, in accordance with some embodiments of the present disclosure.

FIG. 1B is an exemplary scenario that illustrates a gun 106 holding user, in accordance with some embodiments of the present disclosure. As illustrated in FIG. 1B, a user is holding the gun 106 pointing toward another user. The gun 106 may comprise a thermal camera 108 to detect the hidden insignia. The user may wear an eye piece 110. The gun 106 may by communicatively coupled with the eye piece 110 to show a result of detection such as "FIRE" or "NO FIRE".

Figure 1C:
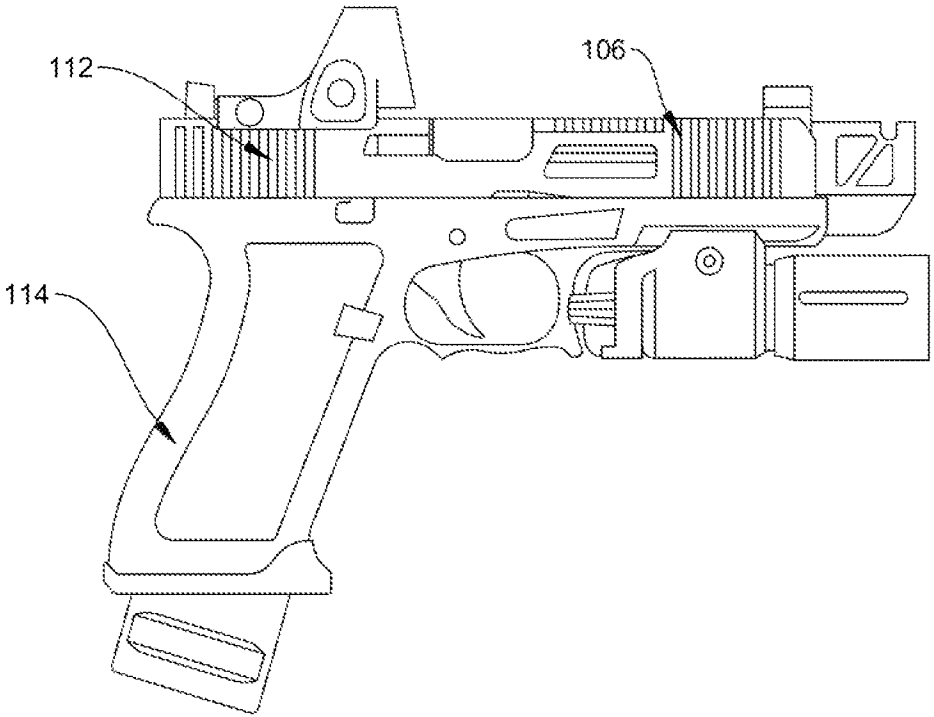
FIG. 1C is another exemplary scenario that illustrates a gun holding user, in accordance with some embodiments of the present disclosure.

FIG. 1C is an exemplary scenario that illustrates the gun 106, in accordance with some embodiments of the present disclosure. The gun 106 may comprise a microprocessor 112 to process the thermal image and compare it to the pre-stored image. According to the comparison, it may be determined that the user should fire or not. The gun 106 may further comprise a battery 114 to provide power to the microprocessor 112.

Figure 2:
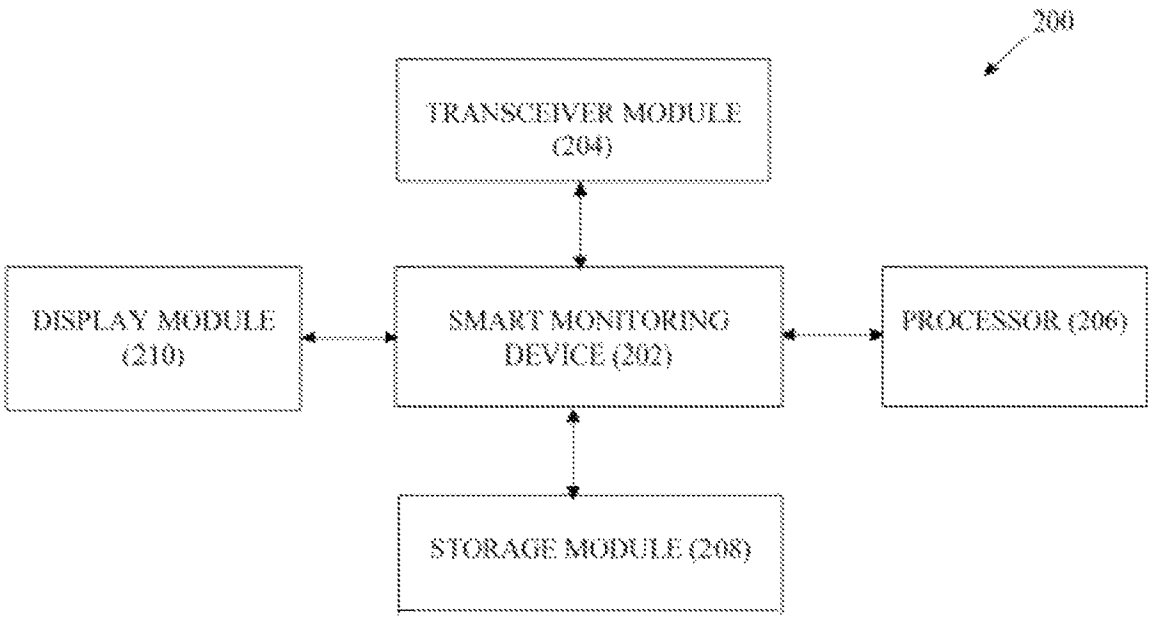
FIG. 2 is a block diagram 200 that illustrates a smart monitoring device, in accordance with some embodiments of the present disclosure.

FIG. 2 is a diagram that illustrates a block diagram 200 for a smart monitoring device, in accordance with some embodiments of the present disclosure. System 200 may include a smart monitoring device 202, a transceiver module 204, a processor/processing module 206, a memory/storage module 208, and a display unit/display module 210. The smart monitoring device 202 may be communicatively coupled to the receiver 204, and the processor 206 via the smart monitoring device 202.

The processor 206 comprises suitable logic, circuitry, interfaces, and/or code that may be configured to execute a set of instructions stored in the memory 208. The processor 206 may be implemented based on a number of processor technologies known in the art. Examples of the processor 206 include, but are not limited to, an X86-based processor, a Reduced Instruction Set Computing (RISC) processor, an Application-Specific Integrated Circuit (ASIC) processor, a Complex Instruction Set Computing (CISC) processor, and/or other processors.

Memory 208 comprises suitable logic, circuitry, interfaces, and/or code that may be configured to store the set of instructions, which may be executed by the processor 206. In an embodiment, the memory 208 may be configured to store one or more programs, routines, or scripts that may be executed in coordination with the processor 206. The memory 208 may be implemented based on a Random Access Memory (RAM), a Read-Only Memory (ROM), a Hard Disk Drive (HDD), a storage server, and/or a Secure Digital (SD) card.

The transceiver 204 comprises suitable logic, circuitry, interfaces, and/or code that may be configured to detect a low-temperature signature of the metal insignia carried by the user with the help of the smart monitoring device 202.

The transceiver 204 may implement one or more known technologies to support wired or wireless communication with the communication network. In an embodiment, the transceiver 204 may include, but is not limited to, an antenna, a radio frequency (RF) transceiver, a Universal Serial Bus (USB) device, a coder-decoder (CODEC) chipset, and/or a subscriber identity module (SIM) card. The transceiver 204 may communicate via wireless communication with networks, such as the Internet, an Intranet and/or a wireless network, such as a cellular telephone network, a wireless local area network (LAN) and/or a metropolitan area network (MAN). The wireless communication may use any of a plurality of communication standards, protocols, and technologies, such as Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The Input/Output (I/O) unit 210 comprises suitable logic, circuitry, interfaces, and/or code that may be configured to receive input or transmit an output. The input/output unit 210 comprises various input and output devices that are configured to communicate with the processor 206. Examples of the input devices include, but are not limited to, a keyboard, a mouse, a joystick, a touch screen, a microphone, and/or a docking station. Examples of the output devices include, but are not limited to, a display screen and/or a speaker.

In an embodiment of the present disclosure, a system 200 for providing a smart monitoring device 202 to determine at least one user as a team mate is disclosed. The system includes a processor 206 to attach a thermal signature emitting unit at one inner portion of the user's clothes, wherein the thermal signature emitting unit corresponds to a temperature signature of a metal insignia. The processor is configured to connect an AI-based thermal camera module to a gun to detect data related to the thermal signature of the metal insignia. Further, the processor 206 is configured to compare the data received from the AI-based thermal camera module with the patterns of the metal insignia stored in the database. Also, a display unit 210 is configured to display a red-cross symbol to the user if the data is matched, wherein the red-cross symbol symbolizes not to shoot.

In yet another embodiment of the present disclosure, the system comprises the processor 206 to insert the thermal signature of the metal insignia inside the bullet proof vest or any other place according to the desire of the user. Further, a storage module 208 is configured to store the data related to the thermal signature of the metal insignia and the data received from the AI-based thermal camera module. Also, the system is configured to store the data based on the temperature of the metal insignia. The system further provides a transceiver module 204 configured to detect a low-temperature signature of the metal insignia carried by the user.

The present invention also includes a memory 208. The memory is coupled to the smart monitoring device 202 and is configured to store the data. In an example embodiment, the present system may be used by a group of policemen in order to catch the thieves in their day-to-day work. In this case, the policemen are not required to worry about their safety at all. The present disclosure allows the policemen to identify their colleagues and hence, prevent them from shooting someone from their own team.

Figure 3:
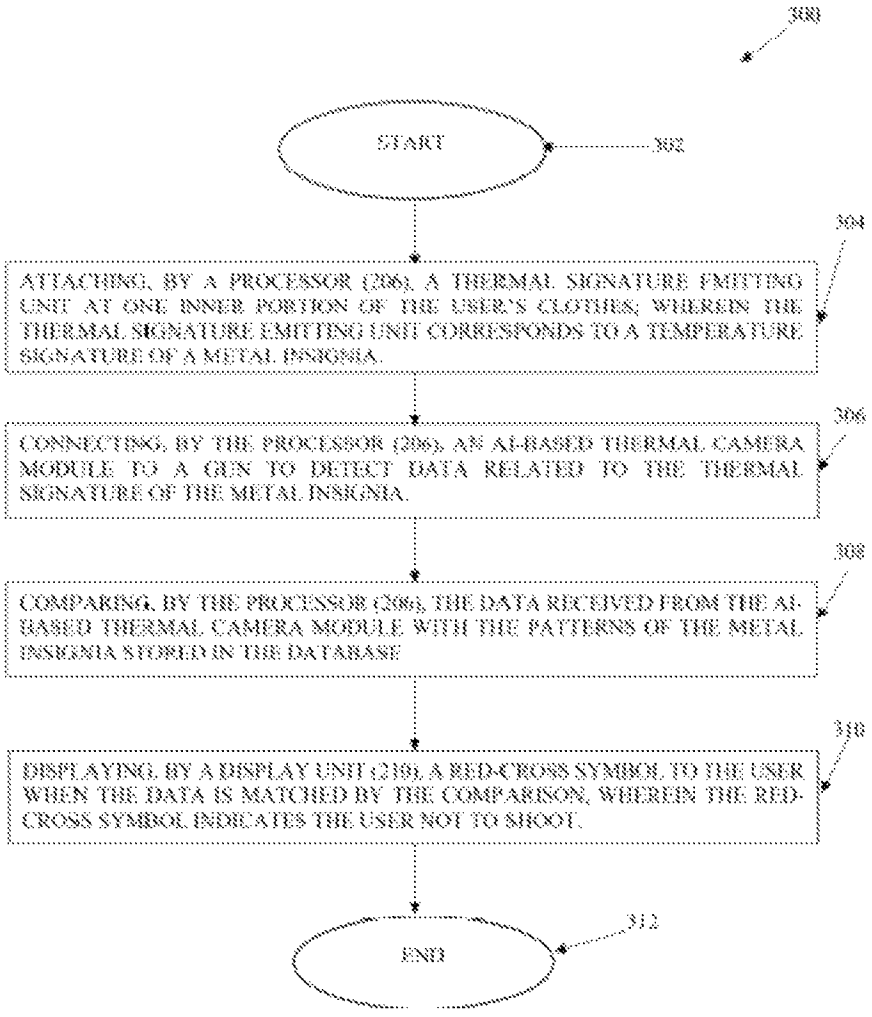
FIG. 3 is a flow diagram 300 that illustrates a smart monitoring device, in accordance with some embodiments of the present disclosure.

FIG. 3 is a flow diagram 300 that illustrates a smart monitoring device, in accordance with some embodiments of the present disclosure. The smart monitoring device comprises a processor, a memory, a transceiver, and an input/output unit. The processor may be communicatively coupled to the memory, the transceiver, and the input/output unit.

In an embodiment of the present disclosure, a method 300 for providing a smart monitoring device to determine at least one user as a team mate is provided. The method begins at step 302. At step 304, the method includes attaching, by a processor 206, a thermal signature emitting unit at one inner portion of the user's clothes, wherein the thermal signature emitting unit corresponds to a temperature signature of a metal insignia. At step 306, the method further includes connecting, by the processor 206, an AI-based thermal camera module to a gun to detect data related to the thermal signature of the metal insignia.

At step 308, the method also includes comparing, by the processor 206, the data received from the AI-based thermal camera module with the patterns of the metal insignia stored in the database. At step 310, the method includes displaying, by a display unit 210, a red-cross symbol to the user when the data is matched by the comparison, wherein the red-cross symbol indicates the user not to shoot. The method finally terminates at step 312.

In yet another embodiment of the present disclosure, the method also includes inserting, by the processor 206, the thermal signature of the metal insignia inside the bullet proof vest or any other place according to the desire of the user. Further, the method includes storing, by a storage module 208, the data related to the thermal signature of the metal insignia and the data received from the AI-based thermal camera module. Also, the method includes storing the data based on the temperature of the metal insignia. Further, the method includes detecting, by a transceiver module 204, a low-temperature signature of the metal insignia carried by the user.

In an example embodiment, one aspect of the present disclosure may be useful for military purposes and security purposes as well. For example, in the rush of adrenaline and sometimes due to nervousness, policemen or army units sometimes shoot one of their own due to darkness or many such reasons. The system activates the metal insignia and thus, the policemen are safe from any accident that may happen. Further, the present invention may store the data in the storing unit as well for future purposes.

In yet another example embodiment, the present disclosure relates to an apparatus, device, or method for detecting a sound signature of a gunshot from the firearm and sensing an aim direction of the firearm substantially at the time of detecting the sound signature of the gunshot. Further, the gun includes the safety elements for determining the geographical location of the gun and the shooting direction. The gun further includes the elements for receiving a safety area map related to the current location via a short-range radio link from the gun. The safety device additionally has elements for determining those moments, when the gun is in the shooting position. When the gun is in the shooting position, the safety device determines the risk area, within which there must be no targets preventing a shooting.

In yet another example embodiment, the present invention may be used by a policeman for military work and for some secret operations. Therefore, the present system becomes very reliable and easy to use. There may be any number of user computers and any number of server computers. Users of computers described herein, for example, maybe interacting with the disclosed systems. These computers may be operated by these users.

Furthermore, one or more computer-readable storage media may be utilized in implementing embodiments consistent with the present invention. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., non-transitory. Examples include Random Access Memory (RAM), Read-Only Memory (ROM), volatile memory, non-volatile memory, hard drives, Compact Disc (CD) ROMs, Digital Video Disc (DVDs), flash drives, disks, and any other known physical storage media.

In light of the above-mentioned advantages and the technical advancements provided by the disclosed method and system, the claimed steps as discussed above are not routine, conventional, or well understood in the art, as the claimed steps enable the following solutions to the existing problems in conventional technologies. Further, the claimed steps clearly bring an improvement in the functioning of the device itself as the claimed steps provide a technical solution to a technical problem.

A description of an embodiment with several components in communication with each other does not imply that all such components are required. On the contrary, a variety of optional components are described to illustrate the wide variety of possible embodiments of the invention.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The present disclosure may be realized in hardware or a combination of hardware and software. The present disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

A person with ordinary skills in the art will appreciate that the systems, modules, and sub-modules have been illustrated and explained to serve as examples and should not be considered limiting in any manner. It will be further appreciated that the variants of the above-disclosed system elements, modules, and other features and functions, or alternatives thereof, may be combined to create other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules, and are not limited to any particular computer hardware, software, middleware, firmware, microcode, and the like. The claims can encompass embodiments for hardware and software, or a combination thereof.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method for providing a smart monitoring device to determine at least one user as a team mate, the smart monitoring device comprising:

attaching, by a processor, a thermal signature emitting unit at one inner portion of the user's clothes, wherein the thermal signature emitting unit corresponds to a temperature signature of a metal insignia;

connecting, by the processor, an AI-based thermal camera module to a gun to detect data related to the thermal signature of the metal insignia;

comparing, by the processor, the data received from the AI-based thermal camera module with patterns of the metal insignia stored in a database; and displaying, by a display unit, a red-cross symbol to the user when the data is matched by the comparison, wherein the red-cross symbol indicates the user not to shoot.

2. The method as claimed in claim 1, wherein the step of attaching, by the processor, the thermal signature emitting unit at one inner portion of the user's clothes further comprising:

inserting, by the processor, the thermal signature of the metal insignia inside the bullet proof vest or any other place according to the desire of the user.

3. The method as claimed in claim 1, wherein the step of connecting, by the processor, the AI-based thermal camera module to the gun to detect data related to the thermal signature of the metal insignia further comprising:

storing, by a storage module, the data related to the thermal signature of the metal insignia; and the data received from the AI-based thermal camera module.

4. The method as claimed in claim 1, wherein the step of comparing, by the processor, the data received from the AI-based thermal camera module with the patterns of the metal insignia stored in the database further comprising:

storing the data based on a temperature of the metal insignia.

5. The method as claimed in claim 1, wherein the step of displaying, by the display unit, a red-cross symbol to the user when the data is matched further comprising:

detecting, by a transceiver module, a low temperature signature of the metal insignia carried by the user.

6. A system for providing a smart monitoring device to determine at least one user as a team mate, the system comprising:

a processor configured to:

attach a thermal signature emitting unit at one inner portion of the user's clothes, wherein the thermal signature emitting unit corresponds to a temperature signature of a metal insignia;

connect an AI-based thermal camera module to a gun to detect data related to the thermal signature of the metal insignia; and compare the data received from the AI-based thermal camera module with patterns of the metal insignia stored in a database; and a display unit configured to display a red-cross symbol to the user when the data is matched by the comparison, wherein the red-cross symbol indicates the user not to shoot.

7. The system as claimed in claim 6, wherein the processor is further configured to insert the thermal signature of the metal insignia inside the bullet proof vest or any other place according to the desire of the user.

8. The system as claimed in claim 6, further comprising a storage module configured to store the data related to the thermal signature of the metal insignia and the data received from the AI-based thermal camera module.

9. The system as claimed in claim 8, wherein the storage module is configured to store the data based on a temperature of the metal insignia.

10. The system as claimed in claim 6, wherein a transceiver module is configured to detect a low temperature signature of the metal insignia carried by the user.

* * * * *